US009711122B1

(12) United States Patent
Van Pelt

(10) Patent No.: US 9,711,122 B1
(45) Date of Patent: Jul. 18, 2017

(54) ACOUSTIC STOMP BOX PERCUSSION DEVICE

(71) Applicant: Jason Van Pelt, McCook, NE (US)

(72) Inventor: Jason Van Pelt, McCook, NE (US)

( * ) Notice: Subject to any disclaimer, the term of this patent is extended or adjusted under 35 U.S.C. 154(b) by 0 days.

(21) Appl. No.: 14/878,848

(22) Filed: Oct. 8, 2015

(51) Int. Cl.
*G10D 13/08* (2006.01)
*G10H 3/14* (2006.01)

(52) U.S. Cl.
CPC ..... *G10H 3/146* (2013.01); *G10H 2220/525* (2013.01)

(58) Field of Classification Search
USPC ..... 84/730
See application file for complete search history.

(56) References Cited

U.S. PATENT DOCUMENTS 4,901,617 A * 2/1990 Malone ..... G10D 13/06 84/402
5,385,075 A * 1/1995 Carnes ..... G10D 13/02 84/411 R
7,807,910 B1 * 10/2010 Berardo ..... G10D 13/02 84/411 R
8,115,088 B2 * 2/2012 Herrera ..... G10D 13/02 84/411 R
8,669,451 B2 * 3/2014 Turner ..... G10D 13/02 84/411 R
8,735,703 B2 * 5/2014 Dublin ..... G10D 13/02 84/411 R
8,829,321 B2 * 9/2014 Klein ..... G10D 13/025 84/411 R
2014/0041508 A1 * 2/2014 Trask ..... G10D 13/025 84/415
2014/0373699 A1 * 12/2014 Drushal ..... G10D 13/021 84/411 R
2015/0135932 A1 * 5/2015 Salomon ..... G10D 13/02 84/411 R
2015/0187344 A1 * 7/2015 James ..... F21V 33/0056 84/411 R
2016/0140940 A1 * 5/2016 Sprengel ..... G10D 7/00 84/170

* cited by examiner

*Primary Examiner* — Christopher Uhlir
(74) *Attorney, Agent, or Firm* — Suiter Swantz pc llo

(57) ABSTRACT

An acoustic stomp box percussion device includes a first chamber having a first area enclosed by a first frame constructed from four frame pieces, a first top plate coupled to the top of the first frame, and a first bottom plate coupled to the bottom of the first frame. Additionally, the acoustic stomp box percussion device includes a second chamber having a second area enclosed by a second frame constructed from four frame pieces, a second top plate coupled to the top of the second frame, and a second bottom plate coupled to the bottom of the second frame. Further, the first chamber and the second chamber are coupled together to form a chamber assembly, and the chamber assembly includes at least one sound modification hardware component and at least one electronic amplification component.

42 Claims, 7 Drawing Sheets

ACOUSTIC STOMP BOX PERCUSSION DEVICE

TECHNICAL FIELD

The present invention generally relates to the field of acoustic percussion instruments, and is further directed to a versatile and portable acoustic percussion stomp box capable of emitting multiple sounds.

BACKGROUND

It is becoming increasingly more common for today's music performance to feature a solo artist or a small group as opposed to an ensemble of multiple musicians. In some cases, the solo artist or small group may have a general lack of desire to perform as part of a (larger) group such as an ensemble. In other cases, the solo artist or small group may be constrained from performing in a full ensemble for various reasons, including performance space, size of equipment, cost of equipment, or cost of hiring additional ensemble performers.

In an ensemble, each musician is tasked with a particular set of instruments including percussion, guitar, bass, keyboard, brass, woodwinds, strings or the like. In contrast, a solo artist or small group may need to perform multiple instruments. These solo artists (e.g., guitarists or pianists) or small groups often wish to complement their main instrument of choice by filling out their performance with additional equipment. Equipment traits such as versatility, quality, and portability are of particular importance to the solo artist or small group, who may be largely self-sufficient concerning the purchasing, hauling, and performing of the instrument.

Often, these individuals' needs are filled by a percussion instrument, which can provide melody, rhythm, and complementing depth to the music during their performances. Such instruments, however, are not without limitations. For instance, a percussion instrument capable of producing multiple sounds—like a drum set—or a set of multiple percussion instruments may be too cumbersome for a single performer to manage or too large for the venue being played. This is particularly problematic to the performer desiring a "kick" or bass drum sound coupled with a snare sound for his performance. In contrast, a more portable instrument—like a set of bongo drums, a djembe drum, a woodblock, a snare, a shaker, or a set of shakers—creates only a single sound or a set of sounds, and are further constrained in the overall sound and tone frequency range of the sounds they can emit.

Smaller percussion instruments are also not generally amplified, meaning its complementing sound could be lost in a larger venue. There are a few percussion devices known to the current art that are amplified, though, including cigar box stomp boxes. Current cigar box stomp boxes, however, are not constructed with proper materials to create sufficiently deep sounds as desired by the performer, nor designed to emit sound acoustically for a performance in a smaller venue. Further, other types of stomp boxes currently known in the art are limited in the variety of generated sounds, and are not able to be played acoustically due to limitations in size, shape, and general design.

Current percussion instruments known to the art are also generally limited to being played in a particular manner. For example, bongo drums, djembe drums, and shakers are designed played solely with one's hands. By way of another example, kick bass drums and stomp boxes currently known in the art are designed to be played solely with one's feet. By way of another example, woodblocks and snare drums are designed to be played solely by striking the instruments with percussion striking devices such as mallets, sticks, brushes, or rods. While there are percussion instruments that may be played with both hands and feet, including a drum set, such percussion instruments may be too large for the solo artist or small group to manage effectively both during transportation and at the venue during the performance.

Therefore, it would be desirable to provide a percussion device that cures the defects of the prior art and provides a solution to the foreseen needs of the performer desiring to complement their main performance with additional sounds. For instance, the percussion device should easily implemented by the performer. Additionally, the percussion device should provide a means of filling out performances without hindering the playing of the main-featured instrument of the performance (e.g. a solo guitarist or a solo pianist would need his hands unencumbered by the percussion device).

Further, it would be desirable that the percussion device be versatile. For instance, the percussion device should be designed to resonate like an acoustic instrument for small venues, but should also provide a means for amplification as needed for larger venues. Additionally, the percussion device should be able to emit multiple sounds, increasing what possibilities are available to fill out the performance while limiting the actual amount of equipment needing transport and monitoring.

Further, it would be desirable that the percussion device be portable and able to be integrated with other performance equipment. For instance, a performer may not have the means to—or perhaps not want to—transport large percussion equipment, meaning the percussion device should have a more mobile profile. Additionally, the percussion device should be able to easily interface with—or at least not inhibit the placement of—the performer's other equipment, including amplifiers and microphone stands.

Further, it would be desirable to have the versatile and portable nature of the percussion device be possible without loss of the emitted sounds' quality. For example, the percussion device should be designed in such a way so as to maximize resonance, tone frequency range, and volume of all emitted sounds.

SUMMARY

An acoustic stomp box percussion device is disclosed. In one illustrative embodiment, the device may include a first area enclosed by a first frame, wherein the first frame is constructed from four frame pieces; a first chamber comprising a first top plate coupled to the top of the first frame; and a first bottom plate coupled to the bottom of the first frame. In another illustrative embodiment, the device may include a second chamber comprising a second area enclosed by a second frame, wherein the second frame is constructed from four frame pieces; a second top plate coupled to the top of the second frame; and a second bottom plate coupled to the bottom of the second frame. In another illustrative embodiment, the first chamber and the second chamber are coupled together to form a chamber assembly. In another illustrative embodiment, the chamber assembly includes at least one sound modification hardware component. In another illustrative embodiment, the chamber assembly further includes at least one electronic amplification component.

A method for constructing an acoustic stomp box percussion device is disclosed. In one illustrative embodiment, the method may include constructing two frames, wherein each frame is comprised of four frame pieces; cutting two top plates, wherein each top plate corresponds to one of the frames; cutting two bottom plates, wherein each bottom plate corresponds to one of the frames; constructing a first chamber and a second chamber, wherein the first chamber and the second chamber are each comprised of one of the frames, the top plate corresponding to the particular frame, and the bottom plate corresponding to the particular frame; removing the top plates from the first chamber and the second chamber; drilling at least one hole into the frames of the first chamber and second chamber; coupling the first chamber and the second chamber together into a chamber assembly; coupling at least one sound modification hardware component to the chamber assembly; coupling at least one electronic amplification component to the chamber assembly; and re-attaching the top plates to the coupled chamber assembly.

It is to be understood that both the foregoing general description and the following detailed description are exemplary and explanatory only and are not necessarily restrictive of the present disclosure. The accompanying drawings, which are incorporated in and constitute a part of the characteristic, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION OF THE INVENTION

Reference will now be made in detail to the subject matter disclosed, which is illustrated in the accompanying drawings.

FIGS. 1A-3 generally illustrate embodiments of an acoustic stomp box percussion device, in accordance with one or more embodiments of the present disclosure. It is noted herein that "acoustic stomp box percussion device" and "Vbox" are used interchangeably throughout the application. It is further noted herein that "user", "musician", "artist", and "performer" are used interchangeably throughout the application.

Figure 1A:
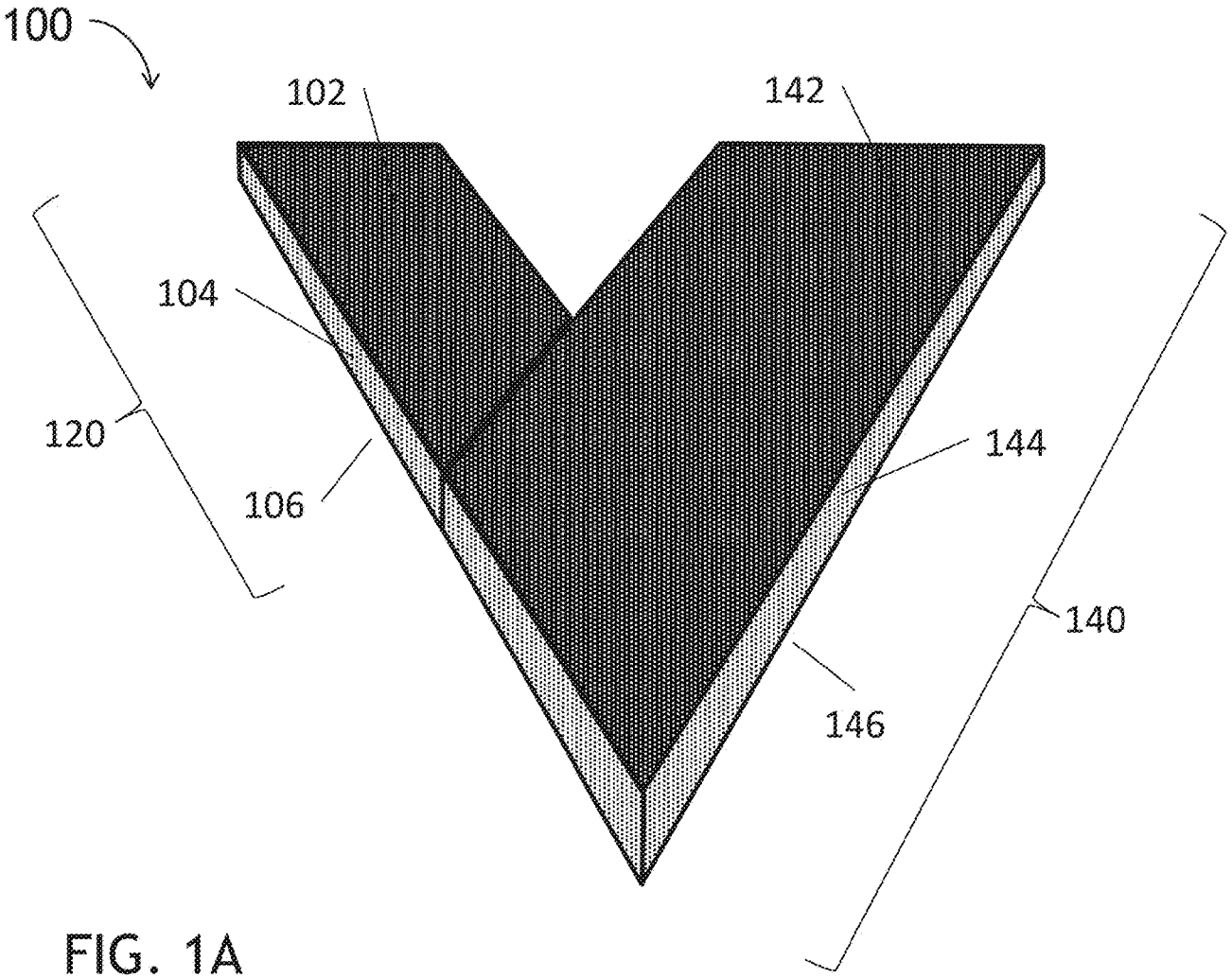
FIG. 1A illustrates an acoustic stomp box percussion device, in accordance with the present disclosure.
Figure 1B:
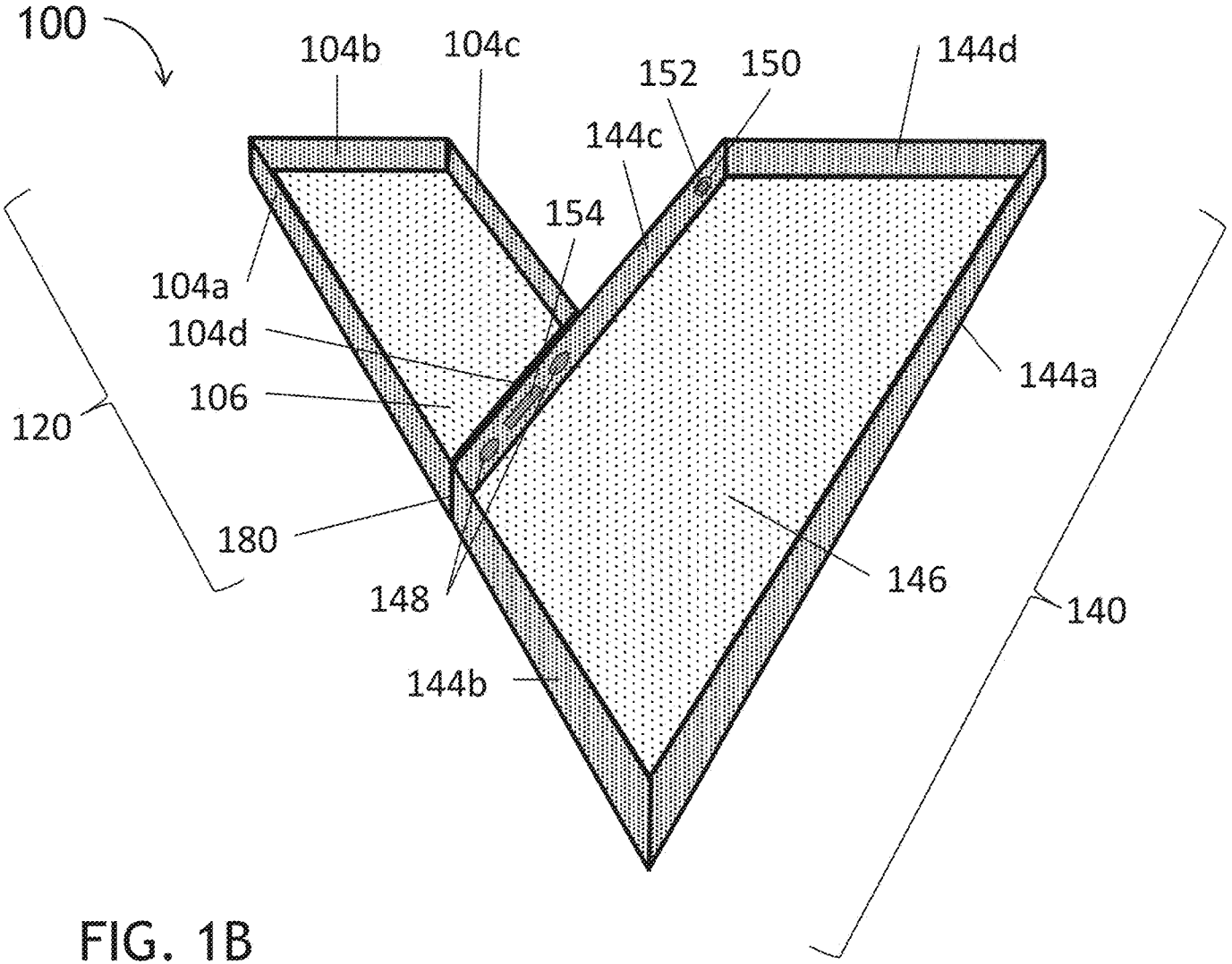
FIG. 1B illustrates an acoustic stomp box percussion device, in accordance with the present disclosure.

Referring now to FIGS. 1A and 1B, a system 100 for an acoustic stomp box percussion device ("Vbox system") is illustrated, in accordance with one or more embodiments of the present disclosure. In one embodiment, a portion of the Vbox system 100 comprising a first top plate 102, a first frame 104, and a first bottom plate 106 is to be considered a small chamber 120 of the Vbox system 100. In another embodiment, a portion of the Vbox system 100 comprising a second top plate 142, a second frame 144, and a second bottom plate 146 is to be considered a large chamber 140 of the Vbox system 100.

In one embodiment, the Vbox system 100 includes the first top plate 102 and the second top plate 142. In another embodiment, the top plates 102 and 142 are ⅛ inch, or approximately 3 mm, thick. In another embodiment, the top plates 102 and 142 are cut to size based on the dimensions of the corresponding frame 104 or 144, discussed in further detail herein.

In another embodiment, the top plates 102 and 142 may be constructed from a first material. For instance, the first material may be a mahogany plywood. For example, mahogany plywood is preferable for the top plates 102 and 142, as it resonates at a lower frequency than most other readily available ⅛ inch plywood types. By way of another example, the use of mahogany plywood allows the Vbox system 100 to achieve a deep bass drum sound in a very low, portable profile.

Additionally, mahogany plywood is a durable and sustainable tonewood. For example, ⅛ inch airplane mahogany is preferred for its particular qualities of durability and resonating ability. Further, with ⅛ inch mahogany plywood for the top plates 102 and 142, the Vbox system 100 vibrates well enough to be played without amplification while remaining durable enough for continued use.

In one embodiment, the Vbox system 100 includes the first bottom plate 106 and the second bottom plate 146. In another embodiment, the bottom plates 106 and 146 may be ⅛ inch, or approximately 3 mm, thick. In an alternative embodiment, the bottom plates 106 and 146 may be approximately 4 mm thick. It is noted that thicker plates up to ¼ inch, or approximately 6 mm, may be used, but that thicker plates also would not resonate as well. In another embodiment, the bottom plates 106 and 146 are cut to size based on the dimensions of the corresponding frame 104 or 144, discussed in further detail herein.

In another embodiment, the bottom plates 106 and 146 may be constructed from a second material. For instance, the second material may be a birch plywood. For instance, birch plywood is preferable for the bottom plates 106 and 146 as it resonates at a higher frequency than mahogany plywood, giving the player more sound options. For example, the use of birch plywood allows the Vbox system 100 to achieve a bongo-like sound, which may create the option for the user to increase the range of his performance set to include several styles of music such as Latin, Caribbean, and Jamaican. Additionally, birch plywood is also a sustainable and durable hardwood.

In one embodiment, the Vbox system 100 includes a first frame 104 comprised of four frame pieces 104*a*-104*d*, and a second frame 144 comprised of four frame pieces 144*a*-144*d*. In another embodiment, frame pieces 104*a*-104*d* and 144*a*-144*d* each measure 1.35 inches wide and between 0.5-0.75 inches thick. For instance, the frame pieces 104*a*-104*d* and 144*a*-144*d* may be 0.625 inches thick. Alternatively, the frame pieces 104*a*-104*d* and 144*a*-144*d* may be 0.75 inches thick. It is noted that the thickness of the frame pieces is important, as thinner boards resonate longer and at lower frequencies while thicker boards result in a higher volume. It is further noted that 0.75 inches is a common board thickness, being more economical than thinner boards and having an excellent balance between resonance, tone frequency, and volume.

In another embodiment, the frame pieces 104*a*-104*d* and the frame pieces 144*a*-144*d* may be composed of a third material. For example, the third material may be a solid maple. It is noted herein that solid maple is used for its superior resonating capabilities. In particular, solid maple resonates longer and over a wider frequency range than a less expensive birch plywood.

It is noted herein that the above examples regarding material types being connected to specific Vbox system 100 components are not limiting and should be interpreted as merely illustrative of the types of materials that may be implemented within the context of the present invention. For instance, the top plates 102 and 142 and bottom plates 106 and 146 may be made from any combination of commercially available solid hardwoods, solid softwoods, and engineered such as plywoods or MDF. Additionally, the frames 104 and 144 may be made from any combination of commercially available solid hardwoods, solid softwoods, or any organic-based or composite-based engineered materials. Additionally, at least one of the sets of top plates 102 and 142, the bottom plates 106 and 146, and the frames 104 and 144 may be made from the same material.

In one embodiment, the four frame pieces 104*a*-104*d* and the four frame pieces 144*a*-144*d* are each arranged into a trapezoidal shape. In another embodiment, cutting the frame pieces to have certain end angles is required to correctly build the respective frames 104 and 144.

In another embodiment, the trapezoidal shape of the chambers 120 and 140 produces the lowest frequency sound possible while making the most efficient use of material. For instance, the long side of a trapezoid-shaped chamber 140 allows for the production of a very low frequency sound in a small profile format from the Vbox system 100.

In another embodiment, the trapezoid-shaped chambers 120 and 140 will emit different frequency sounds depending on where the top plates 102 and 142 or the bottom plates 106 and 146 are struck. For example, striking any of the plates at the center of the long side of the chambers 120 and 140 will produce a lower frequency sound. By way of another example, striking any of the plates towards the sides of the chambers 120 and 140 will produce a higher frequency sound.

In one embodiment, striking the top plates 102 and 142 and the bottom plates 106 and 146 near the edge of the Vbox system 100 produces more sound than striking in the center of the plates.

In another embodiment, the optimal method of producing sound by striking the top plates 102 and 142 includes "stomping" with one's foot along the outer edge. For example, stomping at the center of the long edge of the top plates 102 and 142 will result in the deepest sounds and the loudest volume for that chamber. In another embodiment, producing sound is possible by stomping in the middle of the top plates 102 and 142. It is noted that stomping on the center of the top plates 102 and 142 comes with a risk of breaking the top plates 102 and 142.

In another embodiment, producing sound is possible by striking the middle and/or the edges of the top plates 102 and 142 and the bottom plates 106 and 146 with one's hands. For example, striking the plates along the outer frame will provide more support and more volume. By way of another example, striking the middle of the long edge of the plates will result in the lowest frequencies for the respective chambers 102 and 142 and for the respective sounds produced by striking the top plates 102 or 142 or the bottom plates 106 and 146.

In another embodiment, producing sound is possible by striking the middle and/or the edges of the top plates 102 and 142 and the bottom plates 106 and 146 with percussion striking devices, including mallets, sticks, brushes, rods, or any other percussion striking devices known in the art.

In another embodiment, the Vbox system 100 is capable of producing a shaker-like sound when friction is applied to the exterior of the frames 104 and 144 comprising the chambers 120 and 140.

In one illustrative embodiment, a large version of the Vbox system 100 is shown, in accordance with the present disclosure. In one embodiment, the eight frame pieces are each cut to specific lengths, with the ends of each frame piece cut to a specific angle. For example, frame piece 104*a* measures 14.75 inches and has a 60 degree angle on both ends; frame piece 104*c* measures 8 inches and has a 30 degree angle on both ends; and frame pieces 104*b* and 104*d* each measure 6.875 inches and have a 30 degree angle on one end and a 60 degree angle on the other end. By way of another example, frame piece 144*a* measures 28 inches and has a 60 degree angle on both ends; frame piece 144*c* measures 14.75 inches and has a 30 degree angle on both ends; and frame pieces 144*b* and 144*d* each measure 13.125 inches and have a 30 degree angle on one end and a 60 degree angle on the other end. It is noted that all measurements are to the outside edge of angle.

In another embodiment, these particular Vbox system 100 dimensions may produce a sound as low or lower than many full sized (22 inch) bass drums. For instance, a large chamber 140 having a long-side length of 27 inches achieves a nearly flat frequency response of 20 Hz to 200 Hz.

In another illustrative embodiment, a small version of the Vbox system 100 is shown, in accordance with the present disclosure. In one embodiment, the eight frame pieces each cut to specific lengths, with the ends of each frame piece cut to a specific angle. For example, frame piece 104*a* measures 12.375 inches and has a 60 degree angle on both ends; frame piece 104*c* measures 5.5 inches and has a 30 degree angle on both ends; and frame pieces 104*b* and 104*d* each measure 6.875 inches and have a 30 degree angle on one end and a 60 degree angle on the other end. By way of another example, frame piece 144*a* measures 23.875 inches and has a 60 degree angle on both ends; frame piece 144*c* measures 12.375 inches and has a 30 degree angle on both ends; and frame pieces 144*b* and 144*d* each measure 11.5 inches and have a 30 degree angle on one end and a 60 degree angle on the other end. It is noted that all measurements are to the outside edge of angle.

In another embodiment, these particular Vbox system 100 dimensions—the large chamber 140 having a long-side length of 23 inches—may produce a sound as low or lower to a small jazz bass drum.

In one embodiment, frame pieces 104*a*-104*d* are coupled together with an adhesive to create the first frame 104 and frame pieces 144*a*-144*d* are coupled together with an adhesive to create the second frame 144. In another embodiment, an adhesive is applied a second time to fill any cracks in joints after the first application of adhesive dries. It is noted that applying adhesive multiple times creates optimal vibration qualities of the first frame 104 and the second frame 144 while adding strength. In another embodiment, excess dried adhesive is removed so the first top plate 102, the first bottom plate 106, the second top plate 142, and the second bottom plate 146 may optimally interface with respective frames 104 and 144.

In one embodiment, the top plates 102 and 142 are initially coupled by at least one of an adhesive or fasteners to frames 104 and 144, respectively. For instance, the top plates 102 and 142 may be coupled using #6 screws, ¾ inch in length. Additionally, the screws are placed at ⅜ of an inch from the outer edges and are evenly spaced. For example, spacing for the screws may be at the half-length and quarter-length positions of sides 104*a* and 144*a*; at the half-length position of sides 104*b*, 104*d*, 144*b*, and 144*d*; and in the corners of sides 104*c* and 144*c* of chambers 120 and 140, respectively. By way of another example, screws are placed at 1⅛ inches from the corner of the 60 degree angled corners and at ⅝ inch from the corner of the 30 degree angled corners.

In another embodiment, the bottom plates 106 and 146 are initially coupled by at least one of an adhesive or fasteners to frames 104 and 144, respectively. For instance, the bottom plates 106 and 146 may be coupled using #6 screws, ¾ inch in length. Additionally, the screws are placed at ⅜ of an inch from the outer edges and are evenly spaced. For example, spacing for the screws may be at the half-length and quarter-length positions of sides 104*a* and 144*a*; at the half-length position of sides 104*b*, 104*d*, 144*b*, and 144*d*; and in the corners of sides 104*c* and 144*c* of chambers 120 and 140, respectively. By way of another example, screws are placed at 1⅛ inches from the corner of the 60 degree angled corners and at ⅝ inch from the corner of the 30 degree angled corners.

It is noted there exist a number of combinations how top plates 102 and 142 and bottom plates 106 and 146 are coupled to frames 104 and 144, respectively. In one illustrative embodiment, both the top plates 102 and 142 and the bottom plates 106 and 146 may be coupled by means of fasteners to frames 104 and 144, respectively. For instance, this would allow either set of plates to be removed when access to the contained areas within chambers 120 and 140 is desired. In another illustrative embodiment, top plates 102 and 142 may be coupled with fasteners, and the bottom plates 106 and 146 are coupled using an adhesive, to frames 104 and 144, respectively. For instance, this would allow only top plates 102 and 142 to be removed when access to the contained areas within chambers 120 and 140 is desired. In another illustrative embodiment, the top plates 102 and 142 may be coupled using an adhesive, and the bottom plates 106 and 146 are coupled with fasteners, to frames 104 and 144, respectively. For instance, this would allow only bottom plates 106 and 146 to be removed when access to the contained areas within chambers 120 and 140 is desired.

In another embodiment, the constructed chambers 120 and 140 are sanded and shaped. For instance, all edges are chamfered, beveled, rounded, or treated with a similar finishing procedure known to the art. Additionally, all outside corners are rounded. It is noted that sanding and shaping the Vbox system 100 does not affect the sound but does improve the safety of the Vbox system 100 by eliminating sharp protrusions resulting from the manufacturing process.

In another embodiment, a set of plates are removed from the Vbox system 100 to provide access to the contained areas within chambers 120 and 140. For instance, if the top plates 102 and 142 are coupled with fasteners to frames 104 and 144, then top plates 102 and 142 may be removed to provide access to the contained areas within chambers 102 and 140, respectively. Alternatively, if the bottom plates 106 and 146 are coupled with fasteners to frames 104 and 144, then bottom plates 106 and 146 may be removed to provide access to the contained areas within chambers 102 and 140, respectively. It is noted that the phrase "the removed set of plates" may refer either to the set of top plates 102 and 142 or to the set of bottom plates 106 and 146.

In another embodiment, the removed set of plates and the partially-assembled chambers 120 and 140 are coated with a coating and allowed to dry. For example, the coating may be a lacquer. By way of another example, the coating may be a paint. It is noted that the removed set of plates and the partial chambers 120 and 140 may be coated with the same or with different substances. It is further noted that coating the Vbox system 100, while not necessary, is desired to increase the lifespan of the Vbox system 100.

In another embodiment, the partially-assembled chambers 120 and 140 are coupled together into a chamber assembly. In another embodiment, prior to the coupling of the chamber 120 and 140 into the chamber assembly, a cushion 180 is placed between the two chambers 120 and 140. For instance, the cushion 180 is desired so as to eliminate rubbing of the chambers 120 and 140, and is further desired to give improved sound isolation—particularly when electronic amplification components are installed—between the chamber 120 and 140. For example, the cushion 180 is a piece of black foam. By way of another example, the piece of black foam is ½ inch thick and generally the dimensions of the long-side face of frame piece 104*d*. Further, the cushion 180 may compress when the chambers 120 and 140 are coupled.

In another embodiment, at least one internal component of the Vbox system 100 is installed in the partially-assembled chambers 120 and 140. For instance, the at least one internal component may include at least one coupling hardware, at least one sound modification hardware component, or at least one electronic amplification component, discussed in further detail herein.

In another embodiment, the removed plates are reattached to the partially-assembled chambers 120 and 140. For instance, the removed plates are reattached solely with an adhesive. Alternatively, the removed plates are reattached solely with fasteners. Alternatively still, the removed plates are reattached with both an adhesive and with fasteners. In another embodiment, excess adhesive is removed from the surfaces of Vbox system 100 when wet by wiping it off. Alternatively, the excess adhesive may be removed when dried by sanding it off, but it is possible to damage the previously-applied finish with this sanding.

Figure 1C:
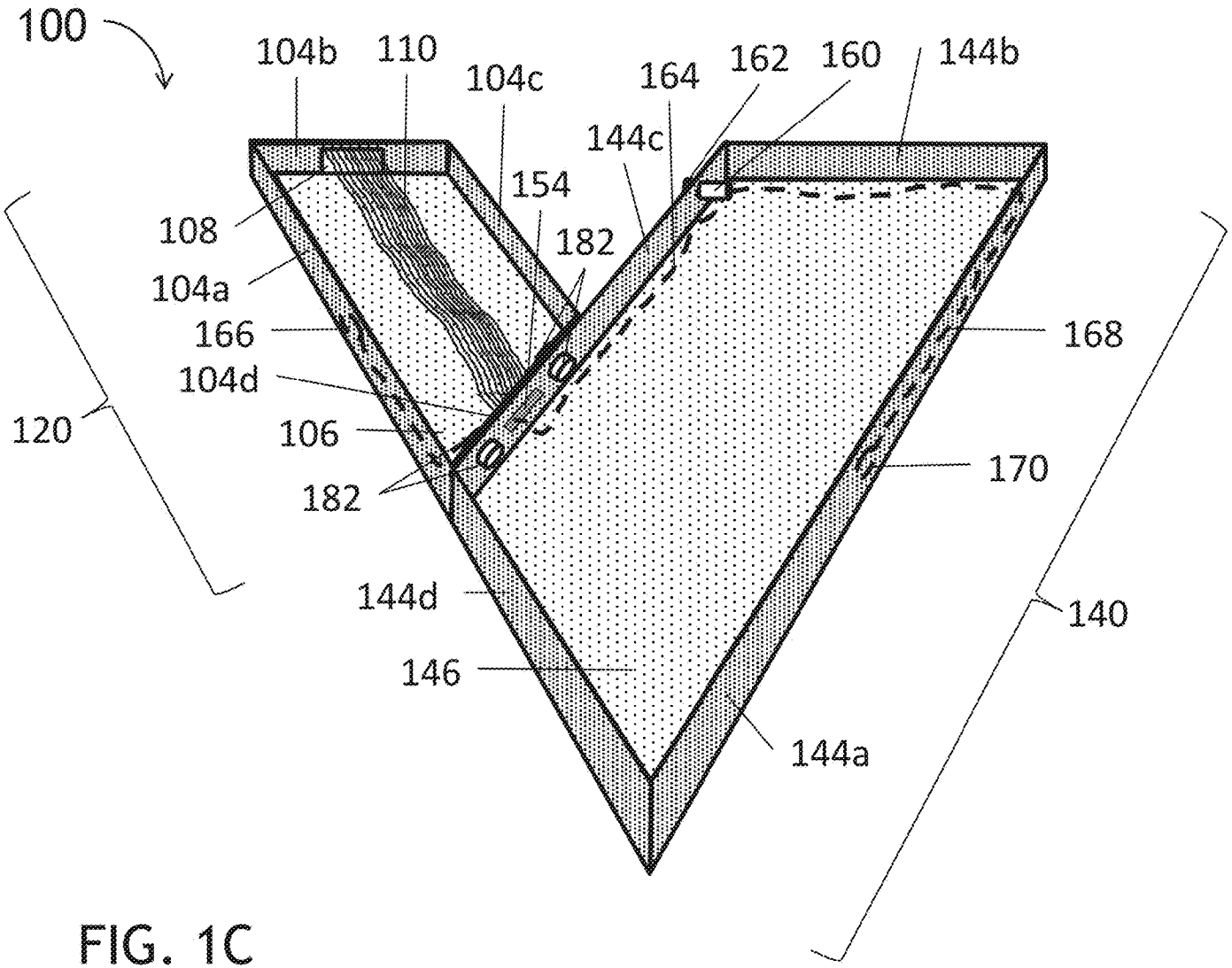
FIG. 1C illustrates an acoustic stomp box percussion device, in accordance with the present disclosure.

In one embodiment, as shown in FIG. 1C, at least one hole is drilled into the Vbox system 100 prior to coupling the partially-assembled chambers 120 and 140 together. In another embodiment, at least one hole 148 is drilled for at least one fastener 182 through the aligned, long-face-touching frame pieces 104*d* and 144*c*, wherein the at least one least fastener 182 may be necessary to fasten the small chamber 120 and the large chamber 140 together. For instance, the Vbox system 100 has two holes 148, each ¼ inch in diameter. It is noted herein that alignment of 104*d* and 144*c* should create a substantially even Vbox system 100 edge comprised of frame pieces 104*a* and 144*b*.

In is noted herein that the above example of coupling the chamber 120 and 140 together by means of at least one fastener is not limiting and should be interpreted as merely illustrative of a means of coupling within the context of the present invention. For instance, the chambers 120 and 140 may be coupled together by means of an adhesive, countersunk magnets in the coupled frame pieces, interlocking grooves on the coupled frame pieces, Velcro, or a hook and latch system on the exterior of the chambers 120 and 140 without significantly inhibiting the desired operation of the Vbox system 100.

In another embodiment, a hole 154 is cut through the aligned, long-face-touching frame pieces 104*d* and 144*c*. For instance, the hole 154 is necessary to allow a piezo pickup wire 164 to pass through from a female phono jack 160 to a piezo pickup 166, discussed in further detail herein. For example, the hole 154 is situated between the two holes 148, and measures approximately ⅜ inches high×1¼ inches in length.

It is noted herein that the above example of hole 154 is not limiting and should be interpreted as merely illustrative of a shape of hole that may be implemented within the context of the present invention. For instance, the shape of hole 154 may be oblong, round, or any n-sided polygon. Additionally, it is contemplated that a grommet or grommet-like plug may be pushed into the at least one hole 154 prior to connecting the pickup wire 164, discussed in further detail herein, so that the pickup wire 164 passes through the grommet. Further, the grommet or grommet-like plug may provide improved sound isolation between the two chambers 120 and 140. It is further noted herein that the Vbox system 100 may include at least a second hole 154.

In another embodiment, a hole 150 is created in frame piece 144*c*. For instance, the hole 150 is necessary to pass and install the female phono jack 160 for purposes of amplifying the Vbox system 100, discussed in further detail herein. For example, the hole 150 is drilled into the inside long-face of frame piece 144*c*, approximately 2 inches from the top inside corner of large chamber 140 as orientated in FIG. 1B. By way of another example, the hole 150 measures approximately ⅞ inch in diameter, and is only drilled ⅝ inch deep into the long-side face of frame piece 144*c*. In another embodiment, a hole 152 is created in frame piece 144*c*. For instance, the hole 152 is necessary to pass and install the female phono jack 160 for purposes of amplifying the Vbox system 100, discussed in further detail herein. For example, the hole 152 is centered on the center point of hole 150. By way of another example, the hole 154 measures approximately 7/16 inch in diameter, and passes through the entirety of the long-side face of frame piece 144*c*.

It is noted herein that the above example of phono jack holes 150 and 152 are not limiting and should be interpreted as merely illustrative of the types of materials that may be implemented within the context of the present invention. For instance, it is contemplated that the placement of the phono jack holes 150 and 152 may be situated on any face of the Vbox system 100, including anywhere on the faces of the frames, the top plates, and the bottom plates. Additionally, the Vbox system 100 may include at least a second hole 150 and at least a second hole 152, to implement at least one additional female phono jack 160 or other electronic amplification components, discussed in further detail herein.

Referring now to FIG. 1C, the Vbox system 100 for an acoustic stomp box percussion device is further illustrated, in accordance with one or more embodiments of the present disclosure. In one embodiment, the Vbox system 100 includes at least one sound modification hardware component. In another embodiment, the Vbox system 100 includes at least one electronic amplification component.

In one embodiment, the small chamber 120 includes a small block 108. For instance, the small block may be made of wood. In another embodiment, the small block 108 is cut so as to have a 60 degree angle along its top surface (i.e. the surface facing towards top plate 102).

In another embodiment, the at least one sound modification hardware component includes a snare 110. For instance, the snare 110 has a mounting surface and fastener holes (not shown). In another embodiment, the snare 110 is coupled to the small chamber 120 at a desired angle to ensure contact with the top plate 102. In another embodiment, the angle of the small block 108 provides a base for mounting the snare 110 at the desired angle. For instance, the snare 110 is coupled to the small block 108 by means of a wedging mechanism, its mounting surface and fasteners holes, or an adhesive. For example, a snare 110 coupled to the small block 108 may be up to 5 inches long, and may further include 20 snare wires. In another embodiment, the ends of the snare 110 are directly coupled to the underside of the top plate 102 by means of an adhesive. It is noted, however, that this particular configuration may inhibit the vibration of the top plate 102.

In another embodiment, at least one additional mounting piece similar to small block 108 may be inserted into the smaller chamber 120. It is noted, however, that the current embodiments constrain the at least one additional mounting piece to maximum dimensions of 2 inches wide, 1 inch thick, and 1 inch tall.

In another embodiment, the smaller chamber 120 may be designed to have a snare 110 control. For instance, the snare 110 control would allow the user to engage and/or disengage the snare against the underside of the top plate 102 as the need for that particular sound arises. For example, the frame piece 104*b* may be modified during manufacturing so as to allow the snare 110 to pass through the side of the frame 104. By way of another example, the snare 110 is then connected to a snare 110 control, which is mounted to the exterior of the frame 104. Alternatively, the snare 110 is fully contained within the small chamber 120, and the snare 110 control coupled to the exterior of the frame 104 includes a mechanism which passes through the frame piece 104*b* and couples to the snare 110 inside the small chamber 120.

It is contemplated that this particular embodiment would require a longer snare 110 than previously embodied. Additionally, the longer snare 110 may require at least a second mounting block inside small chamber 120 to which the second end of the longer snare 110 may couple.

In one embodiment, the at least one electronic amplification component includes a female phono jack 160. For instance, the female phono jack 160 is a ¼ inch female phono jack. In another embodiment, the female phono jack 160 is set inside phono jack hole 150 and passes through the Vbox system 100 frame by means of phono jack hole 152. In another embodiment, the female phono jack 160 is coupled to the Vbox system 100 by means of a phono jack washer and nut 162, situated on the exterior of the Vbox system 100.

In another embodiment, the female phono jack 160 has at least one piezo pickup lead. In another embodiment, the at least one electronic amplification component includes a first pickup wire 164 coupled to a corresponding pickup lead of the female phono jack 160, routed through hole 154 into the smaller chamber 120, and fastened to a first piezo pickup 166. For instance, piezo pickup 166 is coupled to the center of frame piece 104*a* by means of an adhesive. For example, piezo pickup 166 is a ¾ inch pickup.

In another embodiment, the at least one electronic amplification component includes a second pickup wire 168 coupled to a corresponding pickup lead of the female phono jack 160 and routed inside the large chamber 140 to a second piezo pickup 170. For instance, piezo pickup 170 is coupled to the center of frame piece 144*a* by means of an adhesive. For example, piezo pickup 170 is a ¾ inch pickup.

It is noted herein that the pickups 166 and 170 are each coupled to the center of the longest frame piece of chamber 120 and 140, respectively. However, it is contemplated that the placement of the pickups 166 and 170 may be coupled to any surface on the interior of the Vbox system 100, including anywhere on the frames, the top plates, and the bottom plates. Therefore, the above description should not be interpreted as a limitation on the present invention but merely an illustration.

It is further noted herein that, although the ¾ piezo pickups provide excellent frequency response, they do not produce a high-output voltage and more gain is needed to be supplied to compensate for this. Additionally, other sizes of piezo pick-ups are available and may be implemented in Vbox system 100. Further, other types of pickups are usable in the Vbox system 100, including magnetic pickups or a system which combines piezo and magnetic pickups. As such, the above description should not be interpreted as a limitation on the present invention but merely an illustration.

Figure 1D:
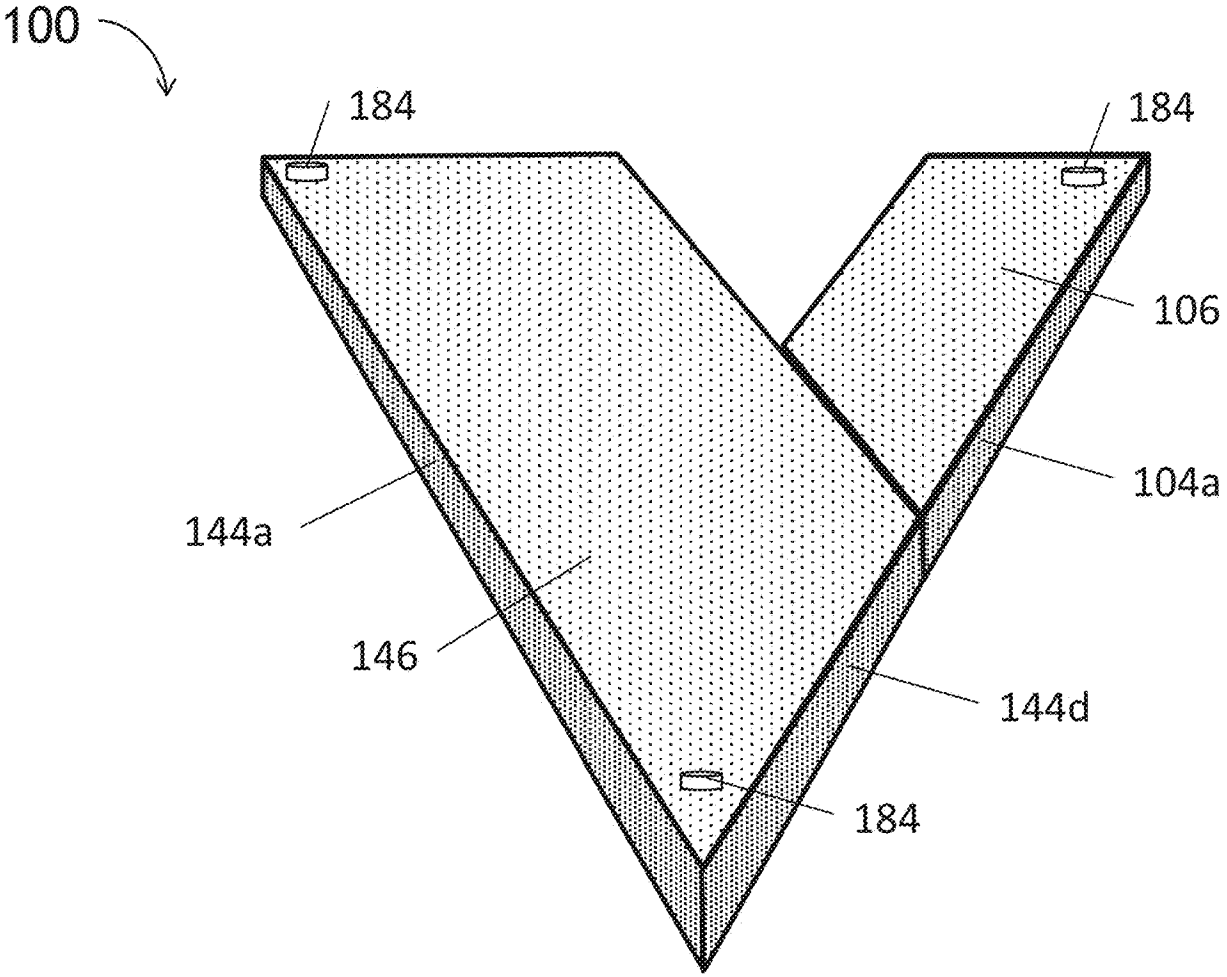
FIG. 1D illustrates an acoustic stomp box percussion device, in accordance with the present disclosure.

Referring now to FIG. 1D, the Vbox system 100 for an acoustic stomp box percussion device is further illustrated, in accordance with one or more embodiments of the present disclosure. In one embodiment, at least one non-slip foot 184 is coupled to the Vbox system 100. For instance, a non-slip foot 184 is coupled to each of three outside corners on bottom plates 106 and 146. Additionally, the at least one non-slip foot 184 has the dimensions of 0.625 inch diameter by ¼ inch tall (approximately 16 mm diameter by 6.35 mm tall).

In another embodiment, the non-slip feet 184 minimally inhibit the playability of the bottom plates 106 and 146 with one's hands. It is contemplated herein that, while the intended method of striking the bottom plates 106 and 146 is with the hands, alternative methods include striking the bottom plates 106 and 146 with feet and with percussion striking devices including mallets, sticks, brushes, rods, or any other percussion striking device known in the art. As such, a second set of at least one non-slip foot may be situated on the top plates 102 and 142.

Figure 1E:
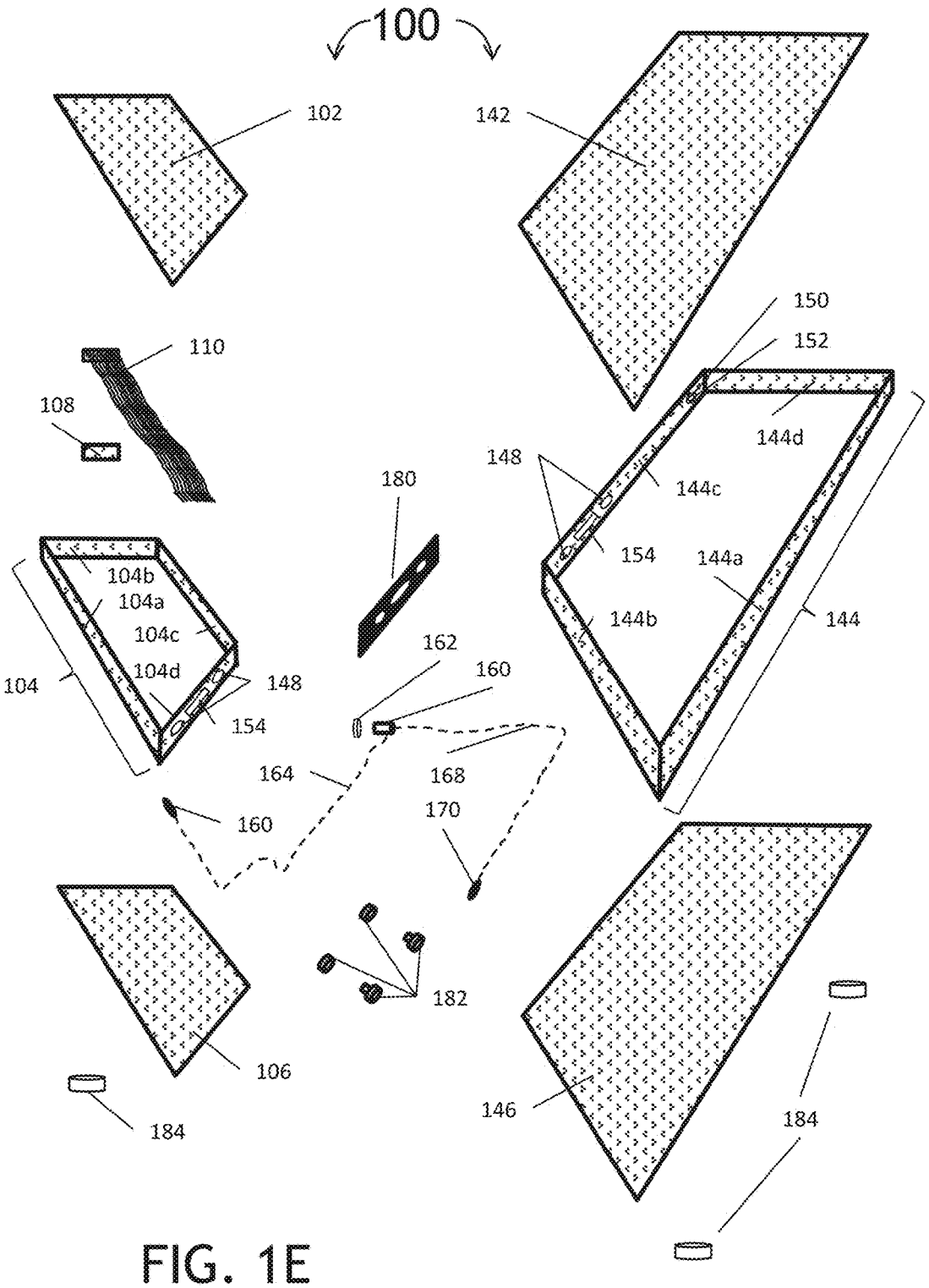
FIG. 1E illustrates an exploded view of an acoustic stomp box percussion device, in accordance with the present disclosure.

Referring now to FIG. 1E, an exploded view of the Vbox system 100 for an acoustic stomp box percussion device is illustrated, in accordance with one or more embodiments of the present disclosure. In one embodiment, the set of top plates 102 and 142, the set of frames 104 and 144, and the set of bottom plates 106 and 146 are each constructed from different materials. In another embodiment, at least one of the set of top plates 102 and 142, the set of frames 104 and 144, and the set of bottom plates 106 and 146 are constructed from the same material.

Figure 2:
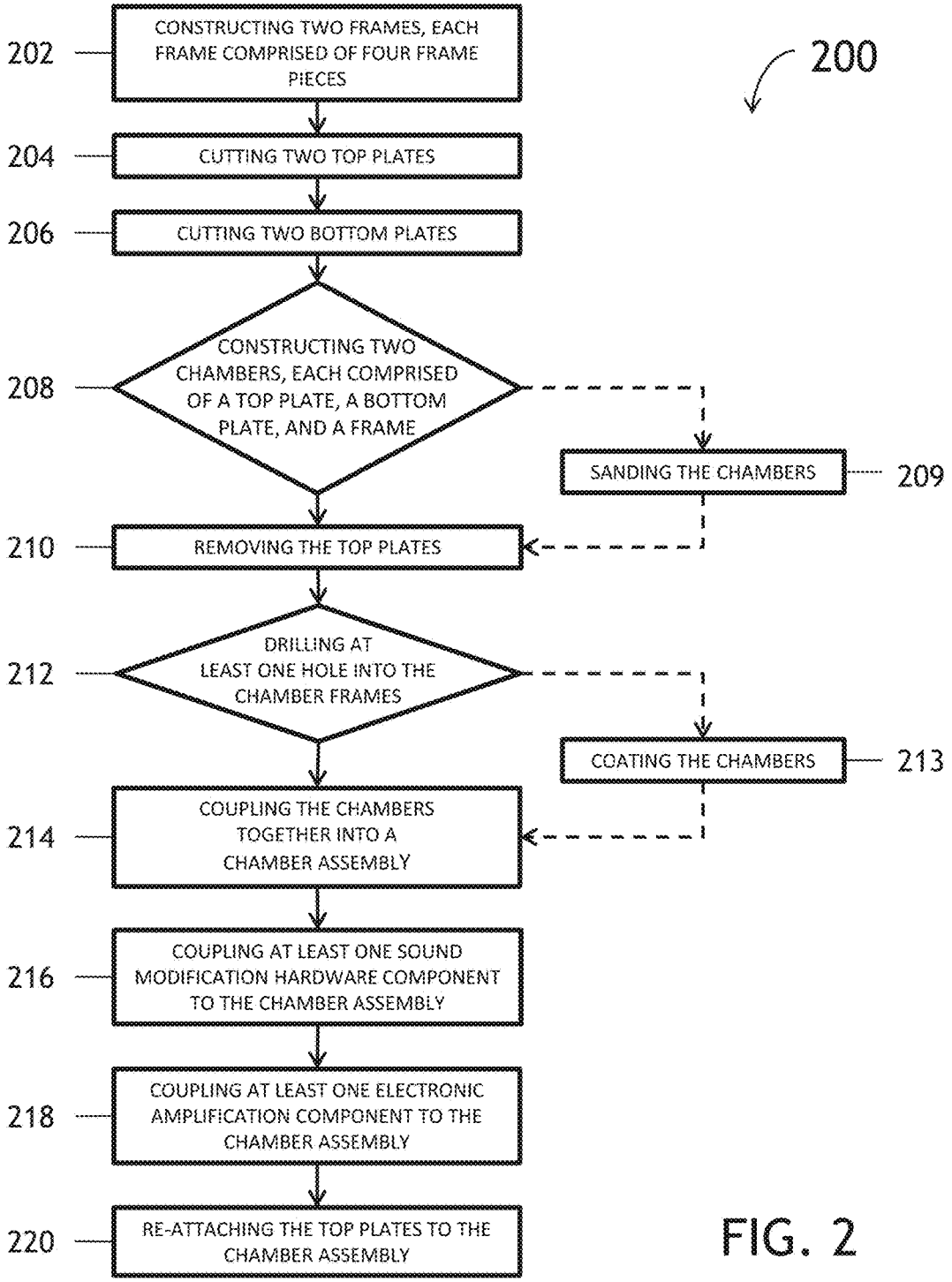
FIG. 2 illustrates a method for constructing an acoustic stomp box percussion device, in accordance with the present disclosure.

Referring now to FIG. 2, a method for manufacturing an acoustic stomp box percussion device is illustrated, in accordance with one or more embodiments of the present disclosure. It is noted herein that the various system embodiments, components and architecture described previously herein should be interpreted to extend to the method 200 of FIG. 2.

In a first step 202, two trapezoid-shaped frames are constructed. In one embodiment, each frame is comprised of four pieces, wherein each piece is cut to a specific length and has specific end angles. In another embodiment, the frames are different sizes. In another embodiment, the frames may be constructed from solid maple.

In a second step 204, two top plates are cut. In one embodiment, each top plate is cut to match a particular frame from step 202. In another embodiment, the top plates are different sizes. In another embodiment, the top plates may be cut from mahogany plywood.

In a third step 206, two bottom plates are cut. In one embodiment, each bottom plate is cut to match a particular frame from step 202. In another embodiment, the bottom plates are different sizes. In another embodiment, the bottom plates may be cut from birch plywood.

In a fourth step 208, a first chamber and a second chamber are constructed by coupling the top and bottom plates to their respective size-matched frames. In one embodiment, the bottom plates may be coupled to the respective frames by at least one of an adhesive or fasteners. In another embodiment, the top plates may be initially coupled to the respective frames by at least one of an adhesive or fasteners.

In an optional step 209, the first chamber and the second chamber are sanded and shaped prior to removing the top plates. In one embodiment, the excess dried adhesive is removed. In another embodiment, the sharp edges and corners are softened.

In a fifth step 210, the top plates are removed from the chambers following the sanding and shaping of the chamber edges.

In a sixth step 212, at least one hole is drilled into the chamber frames. In one embodiment, at least one hole for internal coupling fasteners may be drilled. In another embodiment, at least one hole for electronic amplification components may be drilled. For instance, a female phono jack hole may be drilled. Additionally, a hole to allow a piezo pickup wire to pass from the large chamber to the small chamber may be drilled.

In an optional step 213, the chambers and the top plates are coated with a substance. In one embodiment, the chambers and the top plates may be coated with the same coating substance. In another embodiment, the chambers and the top plates may be coated with different coating substances. For example, the coating substance may include at least one of a lacquer or a paint.

In a seventh step 214, the two chambers are coupled together by means of fasteners through the drilled fasteners holes into a chamber assembly. In another embodiment, a piece of cushioning material is placed between the chambers prior to coupling them together. For instance, the cushioning material may be a piece of foam.

In an eighth step 216, at least one sound modification hardware component is coupled to the chamber assembly. In one embodiment, the sound modification hardware component is a snare coupled to a small block by means of a wedging mechanism, an adhesive, or fasteners to the interior of the small chamber.

In a ninth step 218, at least one electronic amplification component is coupled to the interior of the chamber assembly. In one embodiment, a female phono jack is coupled to the large chamber frame by means of the female phono jack hole. In another embodiment, at least one piezo pickup is coupled to the center of the longest frame pieces of each chamber by means of an adhesive. In another embodiment, at least one piezo pickup wire is coupled to the at least one lead of the female phono jack and the at least one piezo pickup. In another embodiment, the at least one piezo pickup wire is passed through the pickup wire-passing hole drilled between the coupled chambers into order to couple to the at least one lead of the female phono jack and the at least one piezo pickup.

In a tenth step 220, the top plates are reattached to the chamber assembly. In one embodiment, the top plates are reattached solely with an adhesive. In an alternative embodiment, the top plates are reattached solely with fasteners. In an alternative embodiment, the top plates are coupled both with an adhesive and with fasteners. It is noted that excess adhesive may be removed from the finished surface if the top plates were reattached by means of adhesive. In another embodiment, non-slip feet are mounted on each of the three outside corners of the bottom plates.

Figure 3:
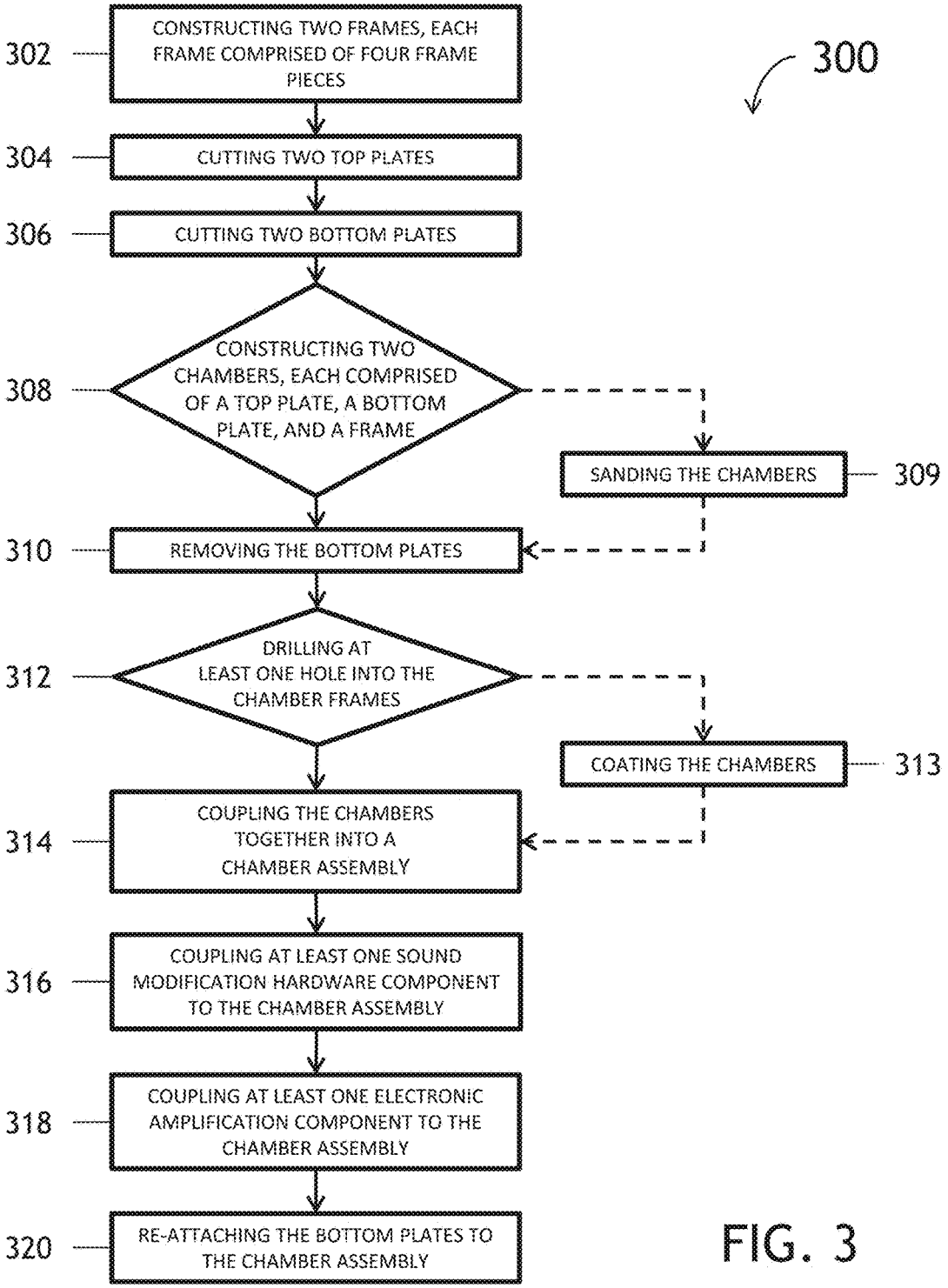
FIG. 3 illustrates a method for constructing an acoustic stomp box percussion device, in accordance with the present disclosure.

Referring now to FIG. 3, a method for manufacturing an acoustic stomp box percussion device is illustrated, in accordance with one or more embodiments of the present disclosure. It is noted herein that the various system embodiments, components and architecture described previously herein should be interpreted to extend to the method 300 of FIG. 3.

In a first step 302, two trapezoid-shaped frames are constructed. In one embodiment, each frame is comprised of four pieces, wherein each piece is cut to a specific length and has specific end angles. In another embodiment, the frames are different sizes. In another embodiment, the frames may be constructed from solid maple.

In a second step 304, two top plates are cut. In one embodiment, each top plate is cut to match a particular frame from step 202. In another embodiment, the top plates are different sizes. In another embodiment, the top plates may be cut from mahogany plywood.

In a third step 306, two bottom plates are cut. In one embodiment, each bottom plate is cut to match a particular frame from step 202. In another embodiment, the bottom plates are different sizes. In another embodiment, the bottom plates may be cut from birch plywood.

In a fourth step 308, a first chamber and a second chamber are constructed by coupling the top and bottom plates to their respective size-matched frames. In one embodiment, the bottom plates may be coupled to the respective frames by at least one of an adhesive or fasteners. In another embodiment, the top plates may be initially coupled to the respective frames by at least one of an adhesive or fasteners.

In an optional step 309, the first chamber and the second chamber are sanded and shaped prior to removing the top plates. In one embodiment, the excess dried adhesive is removed. In another embodiment, the sharp edges and corners are softened.

In a fifth step 310, the bottom plates are removed from the chambers following the sanding and shaping of the chamber edges.

In a sixth step 312, at least one hole is drilled into the chamber frames. In one embodiment, at least one hole for internal coupling fasteners may be drilled. In another embodiment, at least one hole for electronic amplification components may be drilled. For instance, a female phono jack hole may be drilled. Additionally, a hole to allow a piezo pickup wire to pass from the large chamber to the small chamber may be drilled.

In an optional step 313, the chambers and the bottom plates are coated with a substance. In one embodiment, the chambers and the bottom plates may be coated with the same coating substance. In another embodiment, the chambers and the bottom plates may be coated with different coating substances. For example, the coating substance may include at least one of a lacquer or a paint.

In a seventh step 314, the two chambers are coupled together by means of fasteners through the drilled fasteners holes into a chamber assembly. In another embodiment, a piece of cushioning material is placed between the chambers prior to coupling them together. For instance, the cushioning material may be a piece of foam.

In an eighth step 316, at least one sound modification hardware component is coupled to the chamber assembly. In one embodiment, the sound modification hardware component is a snare coupled to a small block by means of a wedging mechanism, an adhesive, or fasteners to the interior of the small chamber.

In a ninth step 318, at least one electronic amplification component is coupled to the interior of the chamber assembly. In one embodiment, a female phono jack is coupled to the large chamber frame by means of the female phono jack hole. In another embodiment, at least one piezo pickup is coupled to the center of the longest frame pieces of each chamber by means of an adhesive. In another embodiment, at least one piezo pickup wire is coupled to the at least one lead of the female phono jack and the at least one piezo pickup. In another embodiment, the at least one piezo pickup wire is passed through the pickup wire-passing hole drilled between the coupled chambers into order to couple to the at least one lead of the female phono jack and the at least one piezo pickup.

In a tenth step 320, the bottom plates are reattached to the chamber assembly. In one embodiment, the bottom plates are reattached solely with an adhesive. In an alternative embodiment, the bottom plates are reattached solely with fasteners. In an alternative embodiment, the bottom plates are coupled both with an adhesive and with fasteners. It is noted that excess adhesive may be removed from the finished surface if the bottom plates were reattached by means of adhesive. In another embodiment, non-slip feet are mounted on each of the three outside corners of the bottom plates.

In one embodiment, the Vbox system 100 is a low profile resonating box drum which can be played with a person's feet, hands, or other percussion striking devices. For instance, one playing method is for a user to tap his feet on the top plates 102 and 142 while standing up or sitting down, thus freeing the user's hands for the main instrument (e.g., guitar or piano). Alternatively, the Vbox system 100 may be played with the hands in a variety of ways, including by striking either the top plates 102 and 142 or striking the bottom plates 106 and 146. Alternatively, the Vbox system 100 could be played with percussion striking devices including mallets, sticks, brushes, rods, or any other percussion striking devices known in the art.

In another embodiment, depending on which top plate 102 or 142 of the respective chambers 120 or 140 is struck, a different sound will be emitted. For example, striking the top plate 142 of the large chamber 140 on the long side will result in a low frequency sound with excellent bass properties. By way of another example, striking the top plate 102 of the small chamber 120 on the long side will result in a snare-like sound. It is noted that the bass-snare sound orientation is generally played with the feet, but may also be played with the hands or with percussion striking devices.

In another embodiment, the Vbox system 100 may be played with the hands. For instance, striking the bottom plates 106 and 146 will result in a bongo drum-like sound. It is noted that using hands or other percussion striking devices allow the user to create more complex rhythm patterns, and further allow the user to include a wide variety of filler sounds in their performance. It is noted that the bongo drum-like sound orientation is generally played with the hands, but may also be played with feet or with percussion striking devices.

In another embodiment, friction may be applied to the frames of the chambers 120 and 140 to create a shaker-like sound.

In another embodiment, the unique trapezoid-shaped design of the Vbox system 100 allows to user to generate a variety of additional sounds around the perimeter of the top plates 102 and 142 of the Vbox system 100. In another embodiment, the available variety of sounds is further expanded by the second set of sounds possible from the bottom plates 106 and 146 of the Vbox system 100. For instance, striking any of the plates at the center of the long side of the chambers 120 and 140 will produce a lower frequency sound. Alternatively, striking any of the plates towards the sides of the chambers 120 and 140 will produce a higher frequency sound.

In another embodiment, the compact profile of the Vbox system 100 allows the Vbox system 100 to be positioned in a variety of ways, including on the floor, on a user's lap, on a table in front of a user, and on a snare stand.

In another embodiment, the construction materials of the Vbox system 100 are capable of producing and projecting sounds acoustically. In another embodiment, the Vbox system 100 may also be amplified by means of the piezo pickups 166 and 170, the female phono jack 160, and separate standard electronic amplification equipment known to the art. In another embodiment, the sound of the Vbox system 100 may be manipulated by equalizers, compression devices, and secondary effects in a separate PA system when passed through the female phono jack 160. It is noted that the versatile nature of the Vbox system 100 means the Vbox system 100 is not constrained for use in certain venues.

In another embodiment, the location of the female phono jack 160 on, and the V-shape of, the Vbox system 100 is conducive to interfacing with a user's other performance equipment. For instance, the female phono jack 160 is positioned to keep any coupled instrument jack cable out of the way of the Vbox system 100 user and have minimal impact on the sounds emitted by the Vbox system 100. Additionally, the V-shape of the Vbox system 100 results in a natural notch which allows a user to place a microphone stands with legs closer to himself than what may be possible with a rectangular-profile stomp box.

Thus, the Vbox system 100 is a device designed to provide a user with a variety of sounds options, including sounds similar to a bass drum, a snare drum, a djembe drum, bongo drums, a woodblock, and a shaker or set of shakers to complement the main performing instrument. Additionally, the Vbox system 100 provides this variety of sound options in a single portable unit, instead of requiring multiple instruments. Further, given the compact nature and the construction of the Vbox system 100, the user is not constrained to only being able to use the Vbox system 100 in certain venues, whereas other percussion instruments may be limited by size and/or the need for acoustic or amplified sounds.

In other embodiments, the materials used for construction and the specific measurements of the chambers 120 and 140 may be altered in such a way that at least one of the first chamber top plate surface 102, the second chamber top plate surface 142, the first chamber bottom plate surface 126, or the second chamber bottom plate surface 146 emit the same sound when struck.

In other embodiments, the chambers 120 and 140 may not be permanently coupled into a chamber assembly. For instance, the chambers 120 and 140 may employ countersunk magnets in the coupled frame pieces, interlocking grooves on the coupled frame pieces, Velcro, or a hook and latch system on the exterior of the chambers 120 and 140. For example, these systems will couple the chambers 120 and 140 together, but still provide the option of separating the boxes for use in another orientation than the Vbox system 100's V shape. Additionally, the non-permanent coupling mechanism may be designed in such a way so as to minimally inhibit emitted sounds. Further, it is contemplated that removing the need for the holes required to implement internal fasteners, and instead relying solely on exterior coupling mechanisms, will provide greater sound isolation between the two chambers 120 and 140.

In other embodiments, where the Vbox system 100 is not permanently coupled but still constructed with amplification electronics, that the amplification electronics are installed in such a way so as not to inhibit the separation of the chambers 120 and 140. For instance, the piezo pickup wire 164 leading to piezo pickup 166 may be longer than the length required if the chambers 120 and 140 were permanently coupled. Additionally, the extended length of piezo pickup wire 164 may be coiled in the larger chamber 140 when the two chambers are coupled together. Further, the extended length of piezo pickup wire 164 may be easily pulled through or pushed back through hole 154 as need be.

In other embodiments, the design and the construction of the Vbox system 100 may be modified to better accommodate round-base microphone stands in a fashion similar to how the current Vbox system 100 will accommodate a microphone stand with legs.

In other embodiments, the internal components may be rearranged within the Vbox system 100. For instance, the snare 110 may be coupled to the interior of the large chamber 140. Additionally, the female phono jack holes 150 and 152 and the female phono jack 160 may be situated in the smaller chamber 120.

Although particular embodiments of this invention have been illustrated, it is apparent that various modifications and embodiments of the invention may be made by those skilled in the art without departing from the scope and spirit of the foregoing disclosure. Accordingly, the scope of the invention should be limited only by the claims appended hereto.

What is claimed:

1. An acoustic stomp box percussion device, comprising:
- a first chamber, comprising;
  - a first area enclosed by a first frame, wherein the first frame is constructed from four frame pieces;
  - a first top plate coupled to the top of the first frame; and
  - a first bottom plate coupled to the bottom of the first frame; and
- a second chamber, comprising:
  - a second area enclosed by a second frame, wherein the second frame is constructed from four frame pieces;
  - a second top plate coupled to the top of the second frame; and
  - a second bottom plate coupled to the bottom of the second frame,
- wherein the first chamber and the second chamber are coupled together to form a chamber assembly, wherein a cushion-like device is inserted between the coupled-together first chamber and second chamber
- wherein the chamber assembly includes at least one sound modification hardware component,
- wherein the chamber assembly further includes at least one electronic amplification component.

2. The acoustic stomp box percussion device of claim 1, wherein the chamber assembly is substantially V-shaped.

3. The acoustic stomp box percussion device of claim 1, wherein the first chamber and the second chamber are trapezoidal in shape.

4. The acoustic stomp box percussion device of claim 1, wherein the first chamber is smaller than the second chamber.

5. The acoustic stomp box percussion device of claim 1, wherein the first chamber and the second chamber are coupled together with fasteners.

6. The acoustic stomp box percussion device of claim 1, wherein the first top plate and the second top plate are constructed from a material, including mahogany.

7. The acoustic stomp box percussion device of claim 1, wherein the first frame and the second frame are constructed from a material, including maple.

8. The acoustic stomp box percussion device of claim 1, wherein the first bottom plate and the second bottom plate are constructed from a material, including birch.

9. The acoustic stomp box percussion device of claim 1, wherein at least two of the first top plate, the second top plate, the first frame, the second frame, the first bottom plate, and the second bottom plate are constructed from the same material.

10. The acoustic stomp box percussion device of claim 1, wherein the first chamber top plate surface, the second chamber top plate surface, the first chamber bottom plate surface, and the second chamber bottom plate surface emit a different sound when struck.

11. The acoustic stomp box percussion device of claim 10, wherein the first chamber top plate surface emits a snare-drum like sound when struck.

12. The acoustic stomp box percussion device of claim 10, wherein the second chamber top plate surface emits a low frequency, bass drum-like sound when struck.

13. The acoustic stomp box percussion device of claim 10, wherein the first chamber bottom plate surface emits a higher frequency bongo drum-like sound when struck.

14. The acoustic stomp box percussion device of claim 10, wherein the second chamber bottom plate surface emits a lower frequency bongo drum-like sound when struck.

15. The acoustic stomp box percussion device of claim 3, wherein the trapezoidal shape of the first chamber and the second chamber causes the first chamber and the second chamber to emit different frequency sounds depending on where the first chamber top plate surface, the second chamber top plate surface, the first chamber bottom plate surface, or the second chamber bottom plate surface are struck.

16. The acoustic stomp box percussion device of claim 1, wherein the chamber assembly emits a shaker-like sound when friction is applied to at least one of the frame pieces of at least one of the frames of the first chamber or the second chamber.

17. The acoustic stomp box percussion device of claim 1, wherein the at least one sound modification hardware component includes a snare.

18. The acoustic stomp box percussion device of claim 17, wherein the snare is coupled to a mounting block in the first chamber by means of at least one of fasteners, an adhesive, or a wedging mechanism.

19. The acoustic stomp box percussion device of claim 17, wherein the snare interfaces with the underside of the first top plate of the first chamber.

20. The acoustic stomp box percussion device of claim 1, wherein the at least one electronic amplification component includes at least one of a female phono jack, one or more piezo pickups, or one or more pickup wires.

21. The acoustic stomp box percussion device of claim 20, wherein the female phono jack is coupled to and passes through a hole cut into the second frame of the second chamber.

22. The acoustic stomp box percussion device of claim 20, wherein the female phono jack has at least one pickup lead.

23. The acoustic stomp box percussion device of claim 20, wherein the one or more piezo pickups is coupled to the interior of at least one of the first chamber or the second chamber.

24. The acoustic stomp box percussion device of claim 20, wherein the one or more pickup wires couple each of the one or more piezo pickups to a corresponding pickup lead on the female phono jack.

25. The acoustic stomp box percussion device of claim 20, wherein the one or more pickup wires pass through a hole between the first chamber and the second chamber to couple one or more piezo pickups to a corresponding pickup lead on the female phono jack.

26. The acoustic stomp box percussion device of claim 1, wherein at least one non-slip foot is coupled to the first bottom plate and the second bottom plate.

27. A method for constructing an acoustic stomp box percussion device, comprising:

constructing two frames, wherein each frame is comprised of four frame pieces;

cutting two top plates, wherein each top plate corresponds to one of the frames;

cutting two bottom plates, wherein each bottom plate corresponds to one of the frames;

constructing a first chamber and a second chamber, wherein the first chamber and the second chamber are each comprised of one of the frames, the top plate corresponding to the particular frame, and the bottom plate corresponding to the particular frame;

removing a set of plates from the first chamber and the second chamber;

drilling at least one hole into the frames of the first chamber and second chamber;

coupling the first chamber and the second chamber together into a chamber assembly, wherein a cushion-like device is inserted between the coupled-together first chamber and second chamber;

coupling at least one sound modification hardware component to the chamber assembly;

coupling at least one electronic amplification component to the chamber assembly; and re-attaching the removed set of plates to the coupled chamber assembly.

28. The method for constructing an acoustic stomp box percussion device in claim 27, further comprising:

sanding the first chamber and the second chamber prior to removing the set of plates.

29. The method for constructing an acoustic stomp box percussion device in claim 27, further comprising:

coating at least one of the first chamber, the second chamber, and the removed set of plates prior to coupling the chambers together into a chamber assembly.

30. The method for constructing an acoustic stomp box percussion device in claim 27, wherein the chamber assembly is substantially V-shaped.

31. The method for constructing an acoustic stomp box percussion device in claim 27, wherein the first chamber and the second chamber are trapezoidal in shape.

32. The method for constructing an acoustic stomp box percussion device in claim 27, wherein the first chamber is smaller than the second chamber.

33. The method for constructing an acoustic stomp box percussion device in claim 27, wherein the set of two top plates, the set of two bottom plates, and the set of two frames are constructed from different materials.

34. The method for constructing an acoustic stomp box percussion device in claim 27, wherein at least one of the set of the two top plates, the set of two bottom plates, and the set of two frames is constructed from the same material.

35. The method for constructing an acoustic stomp box percussion device in claim 27, wherein at least one of the two top plates and the two bottom plates will emit a different sound when struck.

36. The method for constructing an acoustic stomp box percussion device in claim 27, wherein the sound modification hardware component includes a snare coupled to the interior of the first chamber by means of fasteners, an adhesive, or a small block functioning as a wedging mechanism.

37. The method for constructing an acoustic stomp box percussion device in claim 27, wherein the at least one hole in the first chamber and the second chamber include holes for coupling the first chamber and second chamber together.

38. The method for constructing an acoustic stomp box percussion device in claim 27, wherein the at least one hole in the first chamber and the second chamber includes at least one hole for the at least one electronic amplification component.

39. The method for constructing an acoustic stomp box percussion device in claim 27, wherein the at least one electronic amplification component coupled to the chamber assembly includes at least one of a female phono jack, at least one piezo pickup, and at least one piezo pickup wire.

40. The method for constructing an acoustic stomp box percussion device in claim 38, wherein the at least one hole for at least one electronic amplification component includes:

a hole to couple the female phono jack to the chamber assembly, and a hole to pass a piezo pickup wire from one chamber to the second chamber, wherein the piezo pickup wire couples a piezo pickup to a corresponding pickup lead of the female phono jack.

41. The method for constructing an acoustic stomp box percussion device in claim 27, wherein removing a set of plates from the first chamber and the second chamber comprises:

removing the top plate from the first chamber and the second chamber.

42. The method for constructing an acoustic stomp box percussion device in claim 27, wherein removing a set of plates from the first chamber and the second chamber comprises:

removing the bottom plate from the first chamber and the second chamber.

* * * * *